US007744431B2

(12) United States Patent
Trout et al.

(10) Patent No.: US 7,744,431 B2
(45) Date of Patent: Jun. 29, 2010

(54) RECEPTACLE CONTACT WITH A WIDENED MATING TIP

(75) Inventors: David Allison Trout, Lancaster, PA (US); Daniel Robert Ringler, Elizabethville, PA (US); James Lee Fedder, Etters, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/389,853

(22) Filed: Feb. 20, 2009

(65) Prior Publication Data

US 2010/0093232 A1 Apr. 15, 2010

Related U.S. Application Data

(63) Continuation-in-part of application No. 12/250,268, filed on Oct. 13, 2008, and a continuation-in-part of application No. 12/250,299, filed on Oct. 13, 2008.

(51) Int. Cl.
*H01R 13/40* (2006.01)

(52) U.S. Cl. ..... 439/733.1; 439/751; 439/857

(58) Field of Classification Search ..... 439/60, 439/637, 636, 405, 80, 82, 83, 733.1, 751, 439/857

See application file for complete search history.

(56) References Cited

U.S. PATENT DOCUMENTS

| | | | | |
|---|---|---|---|---|
| 5,496,180 | A * | 3/1996 | Fabian et al. | 439/60 |
| 6,231,391 | B1 | 5/2001 | Ramey et al. | |
| 6,439,934 | B1 * | 8/2002 | Yu | 439/733.1 |
| 6,634,911 | B1 * | 10/2003 | Billman et al. | 439/884 |
| 7,018,239 | B2 | 3/2006 | Zaderej et al. | |
| 2008/0214059 | A1 | 9/2008 | Rothermel et al. | |
| 2008/0233806 | A1 | 9/2008 | Rothermel et al. | |

* cited by examiner

*Primary Examiner*—Neil Abrams
*Assistant Examiner*—Phuong Nguyen

(57) ABSTRACT

A receptacle connector includes a housing and a receptacle contact. The housing includes a cavity extending through the housing from the mating side to the mounting side. The receptacle contact is disposed within the cavity and is configured to receive a mating contact of the mating connector. The receptacle contact includes elongated shafts disposed on opposite sides of a longitudinal axis and mating tips coupled to the shafts. The mating tips have tapered shapes between the shafts and outer ends of the mating tips. The tapered shapes are wider than the shafts in a lateral direction that is transverse to the longitudinal axis. The receptacle contact is configured to receive a mating contact of a mating connector between the mating tips to electrically couple the mating connector with the receptacle connector.

20 Claims, 7 Drawing Sheets

RECEPTACLE CONTACT WITH A WIDENED MATING TIP

CROSS-REFERENCE TO RELATED APPLICATIONS

This application is a continuation-in-part of co-pending U.S. patent application Ser. Nos. 12/250,268, entitled "Connector Assembly Having A Noise-Reducing Contact Pattern" and 12/250,299, entitled "Connector Assembly With Variable Stack Heights Having Power And Signal Contacts." Both the Ser. Nos. 12/250,268 and the 12/250,299 applications were filed on Oct. 13, 2008. The subject matter of the Ser. Nos. 12/250,268 and the 12/250,299 applications is herein incorporated by reference in their entirety.

BACKGROUND OF THE INVENTION

The invention relates generally to electrical connectors and, more particularly, to receptacle contacts in a connector assembly.

Connector assemblies include connectors having contacts that mate with one another to electrically couple the connectors. The size and geometry of the contacts in different connector assemblies may vary based on a variety of factors, including the desired electrical impedance characteristic of the connectors, the data rate of signals communicated using the connectors, and the like. The electrical impedance characteristic of the contacts in a connector assembly may need to be adjusted to more closely match the electrical impedance characteristic of the system in which the connector assembly is used. For example, in connector assemblies that communicate data at a relatively high data rate, the electrical impedance characteristic of the contacts may need to be adjusted to more closely match the electrical impedance characteristic of the printed circuit boards to which the connector assemblies are mounted.

One known manner in which the electrical impedance characteristic of the contacts is increased to a predetermined or desired target value is to reduce the amount of conductive material in the contacts. For example, the size and geometry of the contacts may be reduced in order to eliminate or decrease the amount of low electrical impedance areas or volumes in the contacts. Decreasing the amount of conductive material in the contacts by reducing the size and geometry of the contacts, however, comes at a cost. In order to reduce the size and geometry of the contacts, some mechanical features or elements of the contacts may need to be removed or eliminated from the contact. For example, some receptacle contacts have extensions, protrusions or other features that engage the housing of the connector in which the receptacle contacts are located. The features engage the housing in order to properly locate or align the receptacle contacts. The features may engage the housing to ensure that the receptacle contacts are properly positioned to receive mating contacts in order to electrically couple the contacts with one another. Reducing the size or geometry of the contacts may require the elimination of the features that engage the housing. Additionally, reducing the size of the receptacle contacts can reduce the areas of the receptacle contacts that mate with or engage the contacts in a mating connector. Reducing the mating areas of the receptacle contacts may result in inadequate engagement or electrical contact between the mating contacts and the receptacle contacts.

Therefore, in some known connector assemblies, the contacts are shaped to either increase the electrical impedance characteristic of the contacts or to ensure that the contacts engage the connector housing. A need exists to meet both of these demands in connector assemblies, and in connector assemblies designed for high data rates of signal communication.

BRIEF DESCRIPTION OF THE INVENTION

In one embodiment, a receptacle connector that is configured to mate with a mating connector is provided. The receptacle connector includes a housing and a receptacle contact. The housing has a mating side that is configured to engage the mating connector and a mounting side that is configured to be mounted to a substrate. The housing includes a cavity extending through the housing from the mating side to the mounting side. The receptacle contact is disposed within the cavity and is configured to receive a mating contact of the mating connector. The receptacle contact includes elongated shafts disposed on opposite sides of a longitudinal axis and mating tips coupled to the shafts. The mating tips have tapered shapes between the shafts and outer ends of the mating tips. The tapered shapes are wider than the shafts in a lateral direction that is transverse to the longitudinal axis. The receptacle contact is configured to receive a mating contact of the mating connector between the mating tips to electrically couple the mating connector with the receptacle connector.

In another embodiment, a receptacle connector is provided. The receptacle connector includes a housing and a receptacle contact. The housing has a cavity extending along a longitudinal axis and shaped to receive a contact pin of a mating connector when the receptacle connector mates with the mating connector. The housing includes a separation element protruding into the cavity. The receptacle contact is disposed within the cavity and includes contact beams disposed on opposite sides of and extending along the longitudinal axis. The contact beams receive the contact pin to electrically couple the receptacle contact and the contact pin. The contact beams engage the separation element to maintain a separation distance between the contact beams in the cavity. Optionally, the coupling ends of the mating tips engage the separation element in the housing to maintain the separation distance between the contact beams. In one embodiment, the mating tips are wider than the shafts in a direction transverse to the longitudinal axis.

DETAILED DESCRIPTION OF THE INVENTION

Figure 1:
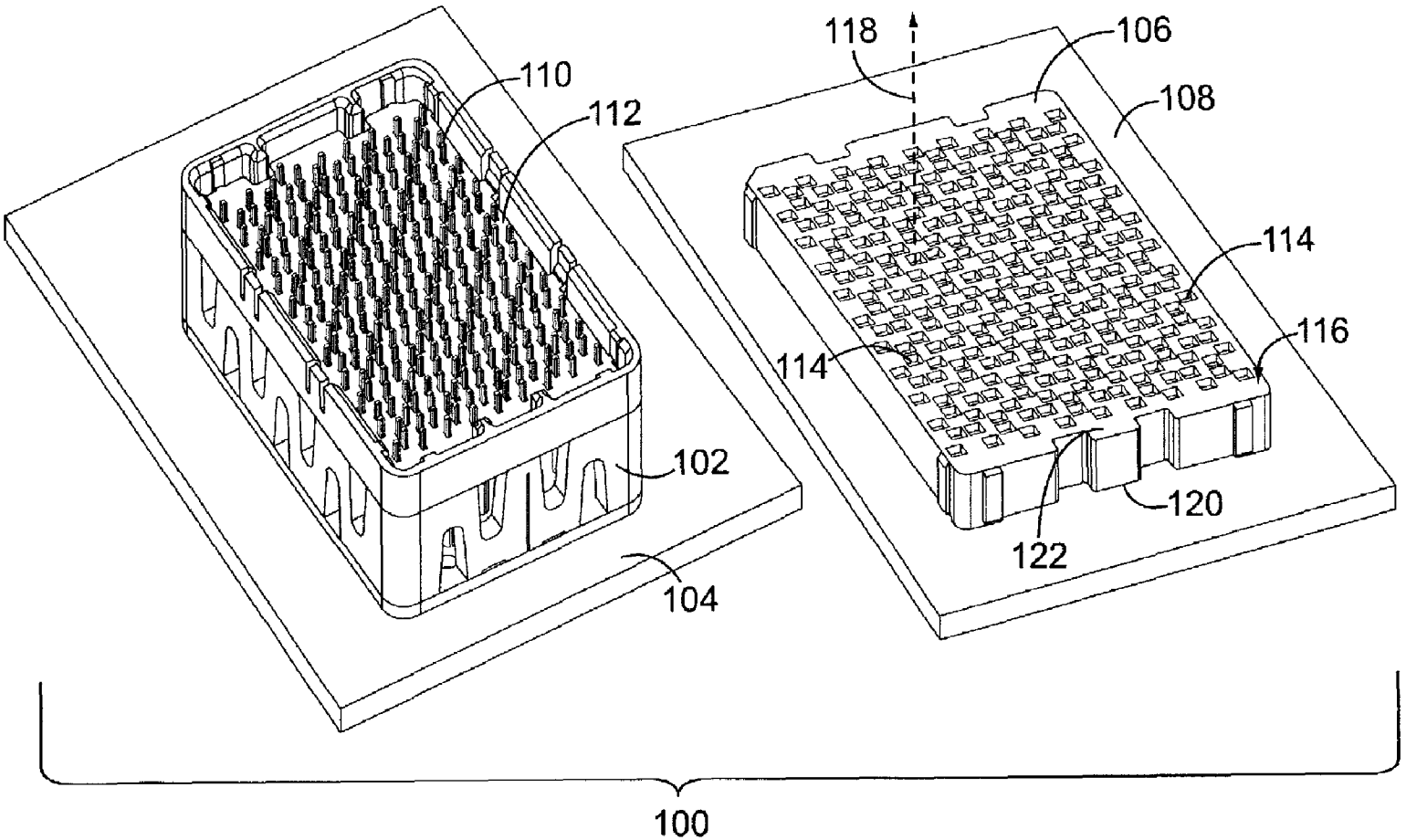
FIG. 1 is a perspective view of a connector assembly according to one embodiment.

FIG. 1 is a perspective view of a connector assembly 100 according to one embodiment. While the connector assembly 100 is illustrated as and described in terms of a mezzanine connector assembly, other types of connectors and connector assemblies may be used in place of the mezzanine connector assembly. The connector assembly 100 includes a mating connector 102 mounted to a first substrate 104 and a receptacle connector 106 mounted to a second substrate 108. The first and second substrates 104, 108 may be embodied in printed circuit boards, for example. Contact pins 110 are disposed in the mating connector 102 and extend through the mating connector 102 from the first substrate 104 through a mating face 112. The contact pins 110 are electrically coupled with conductive pathways (not shown) such as conductive traces in the first substrate 104.

The receptacle connector 106 includes a housing 116 having a mounting side 120 that engages the second substrate 108. The housing 116 includes a mating side 122 on an opposite side of the housing 116. Several cavities 114 extend through the housing 116 from the mating face 112 to the mounting side 120. The cavities 114 may linearly extend through the housing 116 around a longitudinal axis 118 of each cavity 114. Receptacle contacts 200 (shown in FIG. 2) are disposed within the cavities 114. The receptacle contacts 200 may be the same or similar to the receptacle contacts disclosed in the Ser. Nos. 12/250,268 and/or 12/250,299 applications.

The mating connector 102 mates with the receptacle connector 106 to electronically couple the first substrate 104 with the second substrate 108. The mating face 112 of the mating connector 102 engages the housing 116 of the receptacle connector 106 as the contact pins 110 enter into the cavities 114 to mate with the receptacle contacts 200. The contact pins 110 mate with the receptacle contacts 200 to electrically couple the mating connector 102 with the receptacle connector 106 and the first substrate 104 with the second substrate 108.

Figure 2:
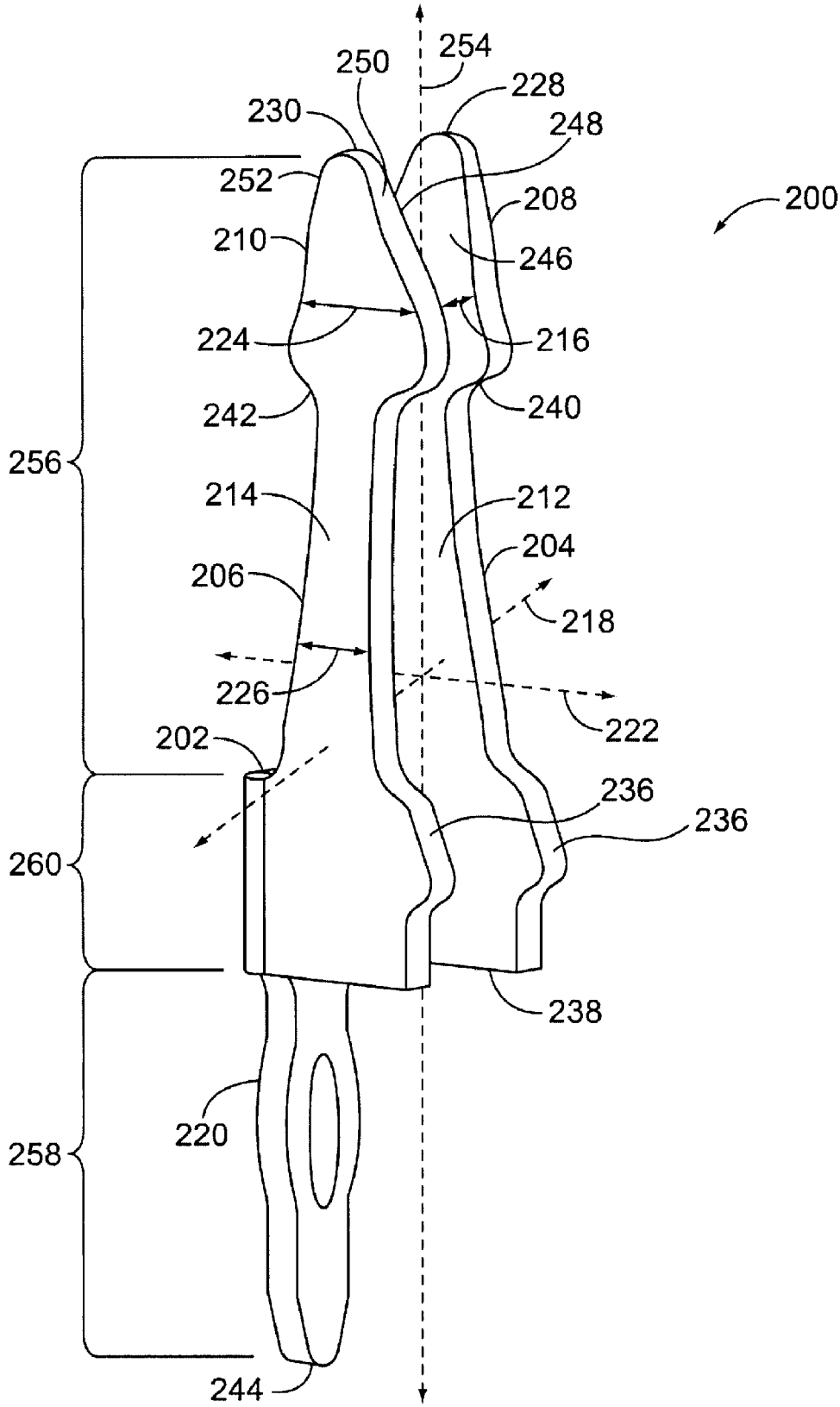
FIG. 2 illustrates a perspective view of receptacle contact in accordance with one embodiment.

FIG. 2 illustrates a perspective view of the receptacle contact 200 in accordance with one embodiment. The receptacle contact 200 may include, or be formed from, a conductive material. For example, the receptacle contact 200 may be stamped and formed from a common sheet of metal. Alternatively, the receptacle contact 200 may be formed from a dielectric material with one or more portions of the receptacle contact 200 being plated with a conductive material. The receptacle contact 200 is generally elongated along a longitudinal axis 254. The longitudinal axis 254 of the receptacle contact 200 may be approximately parallel to, or coextensive with, the longitudinal axis 118 (shown in FIG. 1) of the cavity 114 (shown in FIG. 1) into which the receptacle contact 200 is loaded. The receptacle contact 200 includes a mating portion 256 interconnected with a mounting portion 258 by a retention portion 260. The mating portion 256 receives the contact pin 110 (shown in FIG. 1) to electrically join the receptacle contact 200 with the contact pin 110. The retention portion 260 retains the receptacle contact 200 within the cavity 114 (shown in FIG. 1). The mounting portion 258 electrically and mechanically couples the receptacle contact 200 with the second substrate 108 (shown in FIG. 1). For example, as shown in FIG. 2, the mounting portion 258 may include an eye-of-needle pin 220 that is loaded into a plated opening (not shown) of the second substrate 108. The mounting portion 258 may be partially loaded into the second substrate 108 to electrically couple the receptacle contact 200 with one or more conductive pathways or traces (not shown) in the second substrate 108.

The mating portion 256 includes opposing contact beams 204, 206 joined to the retention portion 260. The contact beams 204, 206 extend from the retention portion 260 to mating tips 208, 210 in a direction generally parallel to the longitudinal axis 254. Elongated shafts 212, 214 of the contact beams 204, 206 interconnect the retention portion 260 with the mating tips 208, 210. As shown in FIG. 2, the opposing shafts 212, 214 may be angled toward one another such that portions of the shafts 212, 214 are disposed closer to one another at or near the mating tips 208, 210 than portions of the shafts 212, 214 at or near the retention portion 260.

The mating tips 208, 210 are separated from each other by a separation distance 216. The separation distance 216 may be measured in a direction parallel to a transverse axis 218 of the receptacle contact 200. The transverse axis 218 is disposed transverse to the longitudinal axis 254 and the lateral axis 222. In the illustrated embodiment, the longitudinal axis 254, the transverse axis 218 and the lateral axis 222 are all approximately perpendicular to one another. The separation distance 216 may be defined as the minimum separation or gap between the mating tips 208, 210 that is required to receive the contact pin 110 (shown in FIG. 1). The mating tips 208, 210 may be angled away from one another to facilitate guidance of the contact pin 110 toward and along the longitudinal axis 254. For example, the mating tips 208, 210 include lead-in surfaces 246, 248 that guide the contact pin 110 (shown in FIG. 1) toward and along the longitudinal axis 254 when the contact pin 110 is loaded into the receptacle contact 200. The areas of the lead-in surfaces 246, 248 provide surfaces for the contact pin 110 to interface with, or engage, when the receptacle contact 200 receives the contact pin 110.

As shown in FIG. 2, the mating tip 208 has a shape that is tapered from a coupling end 240 to an outer end 228 and the mating tip 210 has a shape that is tapered from a coupling end 242 to outer end 230. The tapered shape of each of the mating tips 208, 210 provides a tip width 224 that decreases along the length of the mating tips 208, 210. The tip width 224 may be measured between opposite sides 250, 252 of the contact beams 204, 206 in a direction parallel to a lateral axis 222 of the receptacle contact 200. The lateral axis 222 extends transverse to the longitudinal axis 254. For example, the lateral axis 222 may be approximately perpendicular to the longitudinal axis 254. In the illustrated embodiment, the tip width 224 is greatest for each mating tip 208, 210 at or proximate to the coupling ends 240, 242 and is smallest at or proximate to the outer ends 228, 230.

The size of the shafts 212, 214 may be decreased to adjust the electrical impedance characteristic of the receptacle contact 200. For example, the shafts 212, 214 have a shaft width 226 that is measured between the opposite sides 250, 252 in a direction parallel to the lateral axis 222. The shaft width 226 may be decreased at various locations to reduce the amount of conductive material in the conductive pathway of receptacle contact 200 within the mating portion 256. Reducing the amount of conductive material may increase the electrical impedance characteristic of the receptacle contact 200 to a predetermined or desired target value.

In one embodiment, the largest tip width 224 of the mating tips 208, 210 is larger than the largest shaft width 226. For example, as shown in FIG. 2, the tip width 224 over the length of each of the mating tips 208, 210 is greater than the shaft width 226 over the length of each of the shafts 212, 214. The tip width 224 may be larger than the shaft width 226 in order to allow the mating tips 208, 210 to engage the housing 116, as described below, while also reducing the size and/or materials used in fabricating the contact beams 204, 206.

The retention portion 260 is joined to the mating portion 260 and the mounting portion 258. The retention portion 260 extends between the mating portion 260 and a bottom end 238. The retention portion 260 forms a U-shape that vertically extends along the longitudinal axis 254 between the mounting portion 258 and the mating portion 256. The retention portion 260 shown in FIG. 2 includes a plurality of retention members 236. The retention members 236 outwardly protrude from the retention portion 260 in a direction parallel to the lateral axis 222. The retention members 236 engage the housing 116 (shown in FIG. 1) of the receptacle connector 106 (shown in FIG. 1) to retain the receptacle contact 200 in the cavity 114 (shown in FIG. 1).

The retention portion 260 includes a loading stop element 202. The loading stop element 202 is an upper edge or lip of the retention portion 260. As described below, the loading stop element 202 engages the receptacle connector 106 (shown in FIG. 1) to locate the receptacle contact 200 within the cavity 114 (shown in FIG. 1).

The mounting portion 258 extends between the bottom end 238 of the retention portion 260 to an outer end 244. The mounting portion 258 linearly extends parallel to the longitudinal axis 254 in the illustrated embodiment. The outer end 244 is loaded into the second substrate 108 (shown in FIG. 1) to electrically and mechanically couple the receptacle contact 200 with the second substrate 108. In the illustrated embodiment, the contact beams 204, 206 of the mating portion 256 are located on opposing sides of the longitudinal axis 254 with the mounting portion 258 disposed parallel to the longitudinal axis 254.

Figure 3:
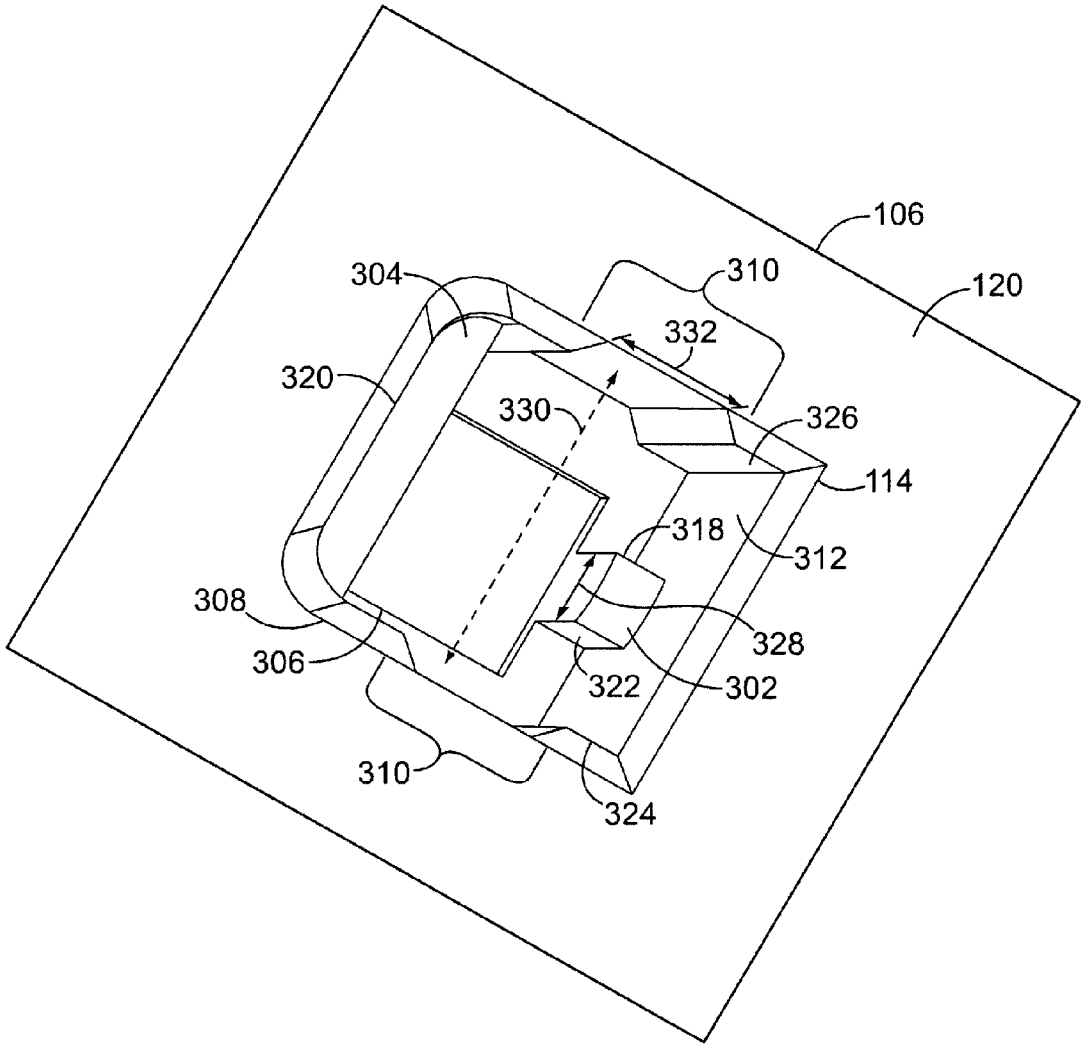
FIG. 3 illustrates a perspective view of a cavity in the receptacle connector shown in FIG. 1 in accordance with one embodiment.

FIG. 3 illustrates a perspective view of one of the cavities 114 from the mounting side 120 of the receptacle connector 106 in accordance with one embodiment. Only a portion of the mounting side 120 is shown in FIG. 3. The cavity 114 extends from an upper opening 306 to a lower opening 308. The upper opening 306 is disposed on the mating side 122 (shown in FIG. 1) of the receptacle connector 106 and the lower opening 308 is disposed on the mounting side 120. The upper opening 306 is generally aligned with the lower opening 308 along the longitudinal axis 118 (shown in FIG. 1) of the cavity 114. The cavity 114 is defined by four inner walls 312, 320, 324, 326 of the receptacle connector 106 in the illustrated embodiment. The inner walls 312, 320 oppose one another and the inner walls 324, 326 oppose one another. The inner walls 312, 320 are approximately parallel to one another and approximately perpendicular to the inner walls 324, 326. The cavity 114 may have a different number of inner walls 312, 320, 324, 326 and/or a different shape than shown in FIG. 3.

The receptacle connector 106 includes a separation element 302 that protrudes into the cavity 114 from the inner wall 312. The separation element 302 protrudes from the inner wall 312 toward the opposing inner wall 320. The separation element 302 has a width dimension 328 in a direction parallel to a transverse axis 330 of the cavity 114. The transverse axis 330 of the cavity 114 is approximately parallel to the transverse axis 218 (shown in FIG. 2) of the receptacle contact 200 (shown in FIG. 2) when the receptacle contact 200 is disposed in the cavity 114. The width dimension 328 may be approximately the same as the separation distance 216 (shown in FIG. 2) between the mating tips 208, 210 (shown in FIG. 2) of the receptacle contact 200. For example, the mating tips 208, 210 engage the separation element 302 when the receptacle contact 200 is loaded into the cavity 114 to separate the mating tips 208, 210 by the separation distance 216. One side of each of the coupling ends 240, 242 (shown in FIG. 2) may engage opposing sides 318, 322 of the separation element 302 to maintain the separation distance 216 between the mating tips 208, 210.

A shoulder 304 extends into the cavity 114 from the inner wall 320. The shoulder 304 protrudes into the cavity 114 to provide a stop for the loading stop element 202 (shown in FIG. 2) of the retention portion 260 (shown in FIG. 2) to engage when the receptacle contact 200 (shown in FIG. 2) is loaded into the cavity 114. The receptacle contact 200 is loaded into the cavity 114 in a direction parallel to the longitudinal axis 118 (shown in FIG. 1) through the mounting side 120 of the housing 116 (shown in FIG. 1). The receptacle contact 200 is loaded into the cavity 114 until the loading stop element 202 engages the shoulder 304. The shoulder 304 may be located in the cavity 114 at a position that defines the location of the mating tips 208, 210 within the cavity 114. For example, the closer that the shoulder 304 is located to the mating side 122, the closer that the mating tips 208, 210 are to the mating side 122 within the cavity 114. The closer that the shoulder 304 is located to the mounting side 120, the farther that the mating tips 208, 210 are from the mating side 122.

The inner walls 324, 326 each include a recess 310. The recess 310 constitutes a portion of the housing 116 that has been cut away or removed from the inner walls 324, 326. The recesses 310 extend into the inner walls 324, 326 in directions generally parallel to the transverse axis 330. Each recess 310 has a width dimension 332 in a direction transverse to the transverse axis 330. For example, the width dimension 332 may extend in a direction that is approximately perpendicular to the transverse axis 330. The recesses 310 provide tip clearance areas for the mating tips 208, 210 (shown in FIG. 2) to move within the cavity 114. The mating tips 208, 210 (shown in FIG. 2) move away from each other when the contact pin 110 (shown in FIG. 1) is received between the mating tips 208, 210. The mating tips 208, 210 may move in directions that are approximately parallel to the transverse axis 330 when the contact pin 110 is received. The recesses 310 extend sufficiently far into the inner walls 324, 326 to permit the mating tips 208, 210 to accept the contact pin 110. The width dimensions 332 of the recesses 310 may be reduced to preserve more of the inner walls 324, 326 to locate or position the receptacle contact 200 within the cavity 144 in a proper or predetermined orientation. For example, the tapered or "arrowhead" shape of the mating tips 208, 210 (shown in FIG. 2) may permit the mating tips 208, 210 to be sufficiently wide to engage the separation element 302 (as described below). The shape of the mating tips 208, 210 also may provide increased mating interface area for the contact pin 110 (shown in FIG. 1) to engage. The tapered shape also may require relatively smaller recesses 310 in order for the outer ends 228, 230 (shown in FIG. 2) of the mating tips 208, 210 to move away from one another. For example, tapering the mating tips 208, 210 may require the recesses 310 to have smaller width dimensions 332 in order to provide sufficient clearance for the mating tips 208, 210.

Figure 4:
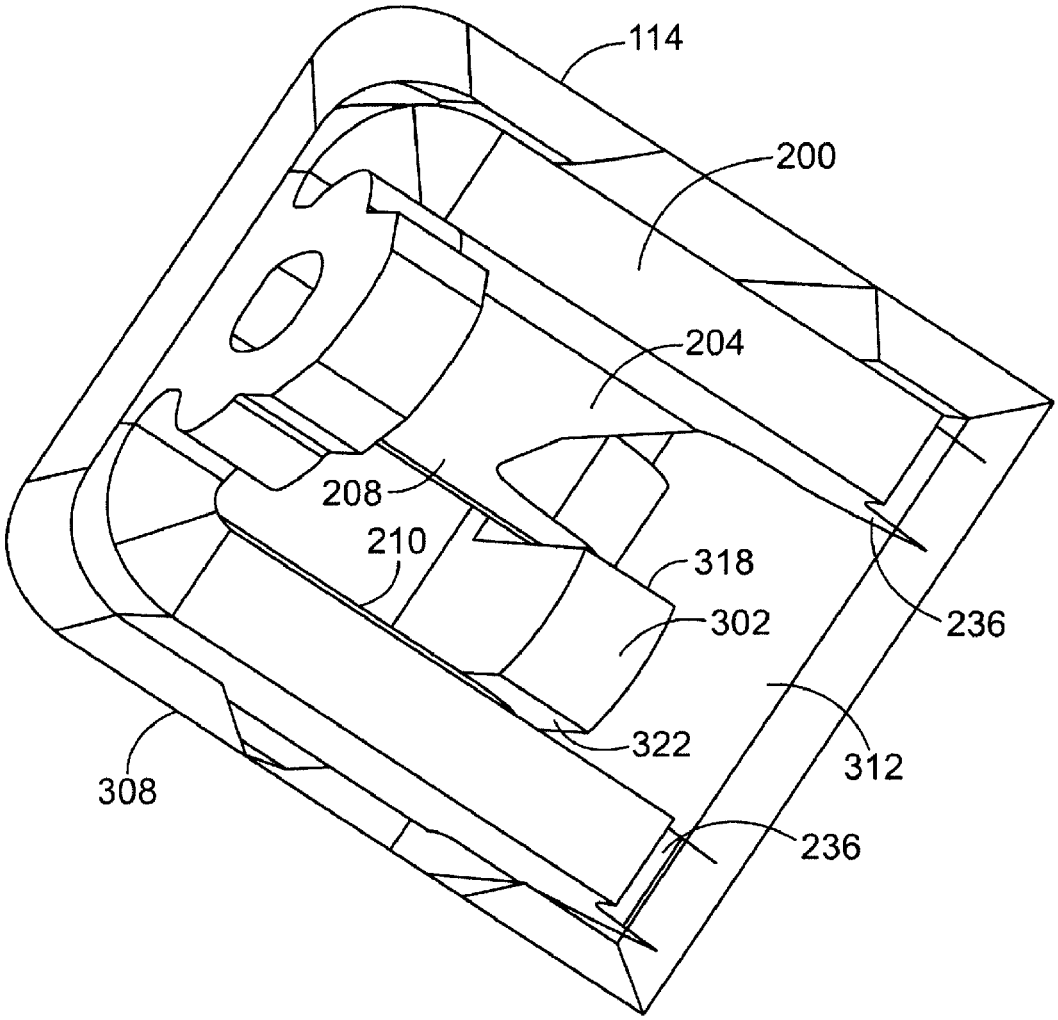
FIG. 4 is a perspective view of the cavity shown in FIG. 1 with the receptacle contact shown in FIG. 2 loaded therein in accordance with one embodiment.

FIG. 4 is a perspective view of the cavity 114 from the mounting side 120 (shown in FIG. 1) of the receptacle connector 106 (shown in FIG. 1) in accordance with one embodiment. The cavity 114 is shown in FIG. 4 with the receptacle contact 200 loaded in the cavity 114. The receptacle contact 200 is loaded into the cavity 114 through the lower opening 308 in the mounting side 120 of the receptacle connector 106. The mating tips 208, 210 engage the opposing sides 318, 322 of the separation element 302 to maintain separation between the mating tips 208, 210. The increased tip width 224 (shown in FIG. 2) of the mating tips 208, 210 permits the engagement between the mating tips 208, 210 and the separation element 302 while permitting the contact beams 204, 206 (shown in FIG. 2) to have material removed in order to increase the electrical impedance characteristic of the receptacle contact 200. The increased tip width 224 also may allow for increased surface area for the mating tips 208, 210 to engage the contact pin 110 (shown in FIG. 1). Also as shown in FIG. 4, the retention members 236 of the contact beams 204, 206 engage the inner wall 312. The retention members 236 may engage the inner wall 312 through an interference fit. The engagement between the retention members 236 and the inner wall 312 prevents the removal of the receptacle contact 200 from the cavity 114.

Figure 5:
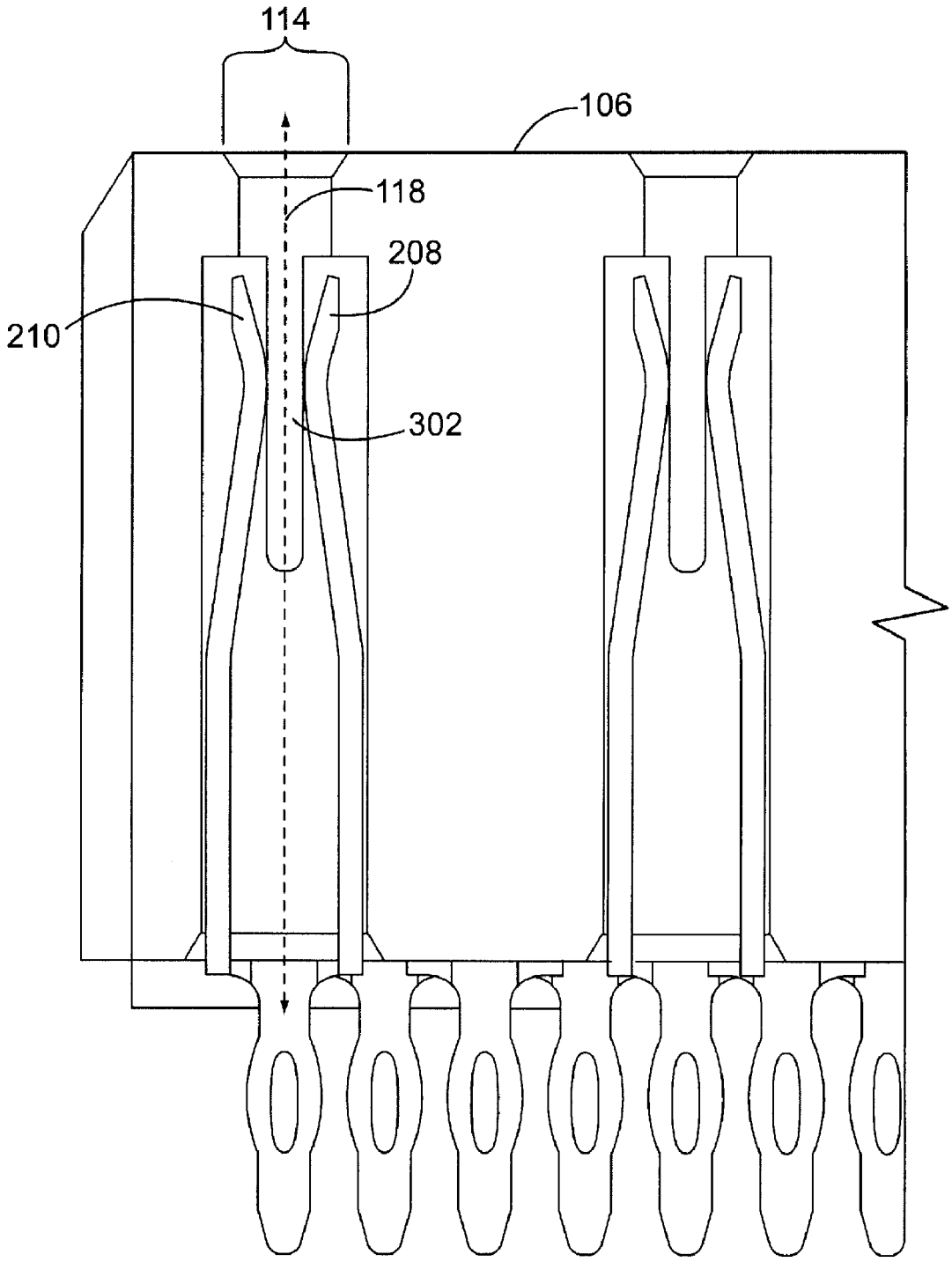
FIG. 5 is a cross-sectional elevational view of the receptacle connector shown in FIG. 1 in accordance with one embodiment.

FIG. 5 is a cross-sectional elevational view of the receptacle connector 106 in accordance with one embodiment. In operation, the contact pin 110 (shown in FIG. 1) is loaded into the cavity 114 in a direction generally along the longitudinal axis 118. The contact pin 110 is loaded into the cavity 114 until the contact pin 110 engages one or both of the mating tips 208, 210. The separation of the mating tips 208, 210 by the separation element 302 prevents the contact pin 110 from stubbing or otherwise striking the mating tips 208, 210 in such a way as to prevent loading of the contact pin 110 into the receptacle contact 200. For example, as shown in FIG. 5, the mating tips 208, 210 are angled away from one another and separated, thereby forming a flared opening to receive and guide the contact pin 110 and prevent stubbing of the contact pin 110 on the mating tips 208, 210. The mating tips 208, 210 guide the contact pin 110 generally along the longitudinal axis 118 as the contact pin 110 is received between the mating tips 208, 210.

Figure 6:
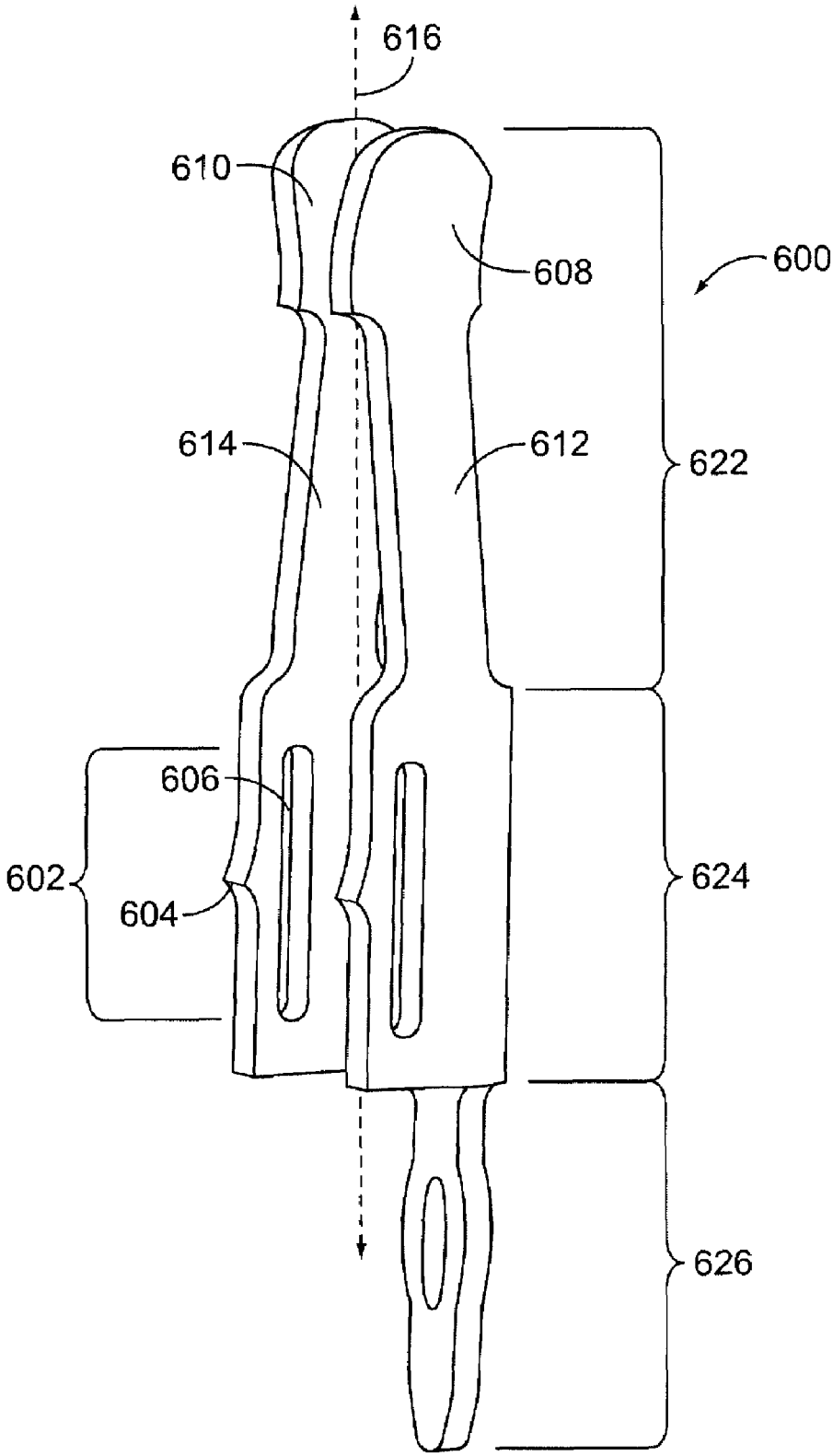
FIG. 6 is a perspective view of a receptacle contact in accordance with another embodiment.

FIG. 6 is a perspective view of a receptacle contact 600 in accordance with another embodiment. The receptacle contact 600 may be similar to the receptacle contact 200 shown in FIG. 2. For example, the receptacle contact 600 includes a mating portion 622 interconnected with a mounting portion 626 by a retention portion 624. The mating portion 622 receives the contact pin 110 (shown in FIG. 1) to electrically couple the receptacle contact 600 with the contact pin 110. The retention portion 624 engages a receptacle connector such as the receptacle connector 106 (shown in FIG. 1) to secure the receptacle contact 600 in the receptacle connector 106. For example, the receptacle contact 600 may be loaded into the cavity 114 (shown in FIG. 1) of the receptacle connector 106 with the retention portion 624 engaging the receptacle connector 106 inside the cavity 114. The mounting portion 626 is loaded or inserted into the second substrate 108 (shown in FIG. 1) to electrically and mechanically couple the receptacle contact 600 with the second substrate 108.

The mating portion 622 includes opposing beams 612, 614 that are elongated parallel to a longitudinal axis 616 of the receptacle contact 600. The contact beams 612, 614 are located on opposite sides of the longitudinal axis 616. The contact beams 612, 614 may be similar to the contact beams 204, 206. The contact beams 612, 614 include mating tips 608, 610 that engage the contact pin 110 (shown in FIG. 1). The mating tips 608, 610 may have a rounded shape such as shown in FIG. 6. Alternatively, the mating tips 608, 610 may be tapered similar to the mating tips 208, 210 shown in FIG. 2. The contact beams 612, 614 are joined to the retention portion 624.

The retention portion 624 shown in FIG. 6 includes a plurality of retention members 602. Each of the retention members 602 includes an outwardly protruding barb 604 and an opening 606. The barbs 604 outwardly protrude from the retention portion 624. The barbs 604 protrude from the retention portion 624 in a direction transverse to the longitudinal axis 616. The openings 606 permit the barbs 604 to partially collapse inward. The barbs 604 may be forced inward when the receptacle contact 600 is loaded into the cavity 114 (shown in FIG. 1) and the barbs 604 engage the receptacle connector 106 inside the cavity 114. For example, the barbs 604 may engage the inner wall 312 (shown in FIG. 3) of the housing 116 (shown in FIG. 1) when the receptacle contact 600 is loaded into the cavity 114. The engagement between the barbs 604 and the inner wall 312 may cause the barbs 604 to collapse inward to at least partially close the openings 606.

Figure 7:
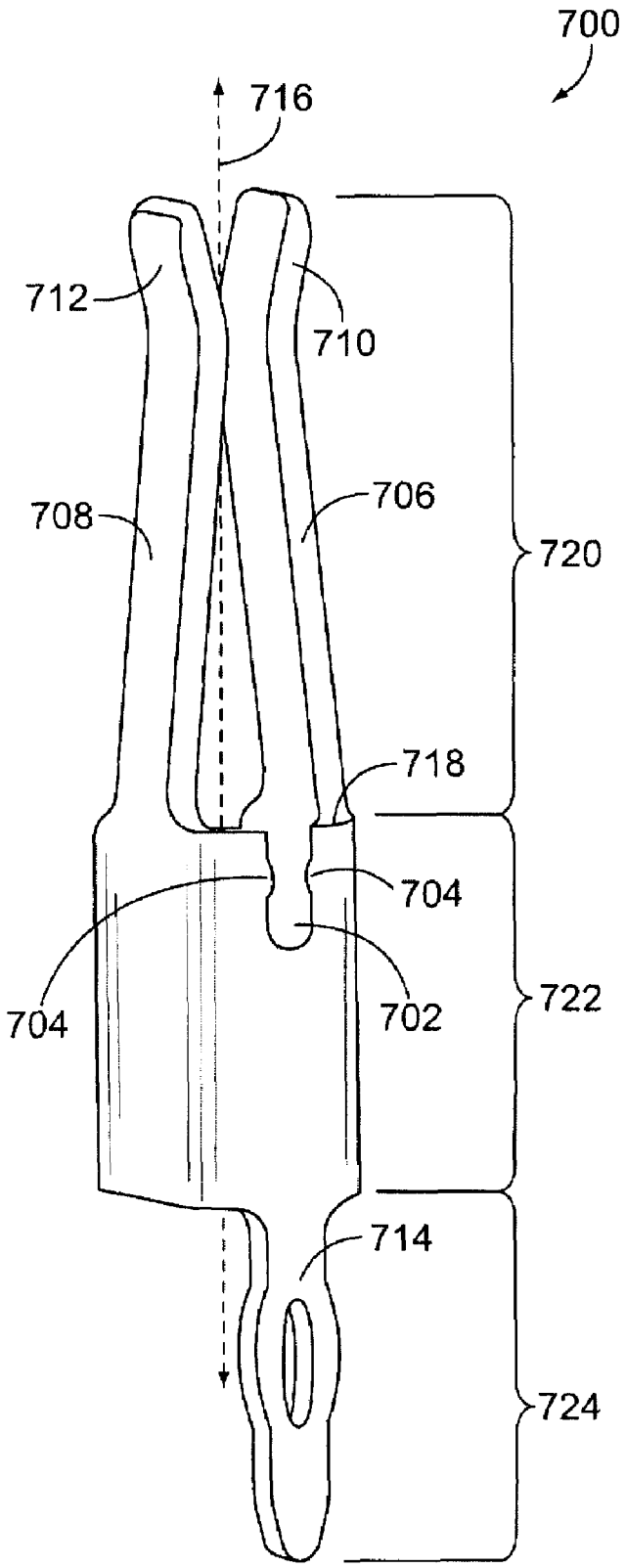
FIG. 7 is a perspective view of a receptacle contact in accordance with another embodiment.

FIG. 7 is a perspective view of a receptacle contact 700 in accordance with another embodiment. The receptacle contact 700 may be similar to the receptacle contact 200 (shown in FIG. 2). For example, the receptacle contact 700 includes a mating portion 720 interconnected with a mounting portion 724 by a retention portion 722. The mating portion 720 receives the contact pin 110 (shown in FIG. 1) to electrically couple the receptacle contact 700 with the contact pin 110. The retention portion 722 engages a receptacle connector such as the receptacle connector 106 (shown in FIG. 1) to secure the receptacle contact 700 in the receptacle connector 106. For example, the receptacle contact 700 may be loaded into the cavity 114 (shown in FIG. 1) of the receptacle connector 106 with the retention portion 722 engaging the receptacle connector 106 inside the cavity 114. The mounting portion 724 is loaded or inserted into the second substrate 108 (shown in FIG. 1) to electrically and mechanically couple the receptacle contact 700 with the second substrate 108

The receptacle contact 700 is elongated along a longitudinal axis 716. The mating portion 720 includes opposing contact beams 706, 708 that may be similar to the contact beams 204, 206 (shown in FIG. 2). The contact beams 706, 708 include mating tips 710, 712 that receive and engage the contact pin 110 (shown in FIG. 1). The mating tips 710, 712 may be shaped as shown in FIG. 7. Alternatively, the mating tips 710, 712 may take the shape of the mating tips 208, 210 (shown in FIG. 2) or the mating tips 608, 610 (shown in FIG. 6).

The retention portion 722 is similar to the retention portion 260 (shown in FIG. 2). One difference between the retention portion 722 and the retention portion 722 is the inclusion of a slot 702 and opposing retention members 704 in the retention portion 722. The slot 702 extends from a loading stop element 718 to an inner edge 720. The loading stop element 718 may be similar to the loading stop element 202 (shown in FIG. 2) of the receptacle contact 200 (shown in FIG. 2). The loading stop element 718 engages a shoulder similar to the shoulder 304 (shown in FIG. 3) to limit the displacement of the receptacle contact 700 in a loading direction 722 when the receptacle contact 700 is loaded into a cavity similar to the cavity 114 (shown in FIG. 1). The slot 702 is shaped to fit a protrusion (not shown) of the housing 116 (shown in FIG. 1). For example, the cavity 114 may include an additional protrusion similar to the separation element 302 (shown in FIG. 3). This additional protrusion may extend from the inner wall 320 (shown in FIG. 3) toward the inner wall 312 (shown in FIG. 3). This additional protrusion may be shaped to fit within the slot 702 when the receptacle contact 700 is loaded into the cavity 114.

The retention members 704 protrude toward one another within the slot 702. The retention members 704 engage opposing sides of the additional protrusion in the cavity 114 (shown in FIG. 1) to retain the receptacle contact 700 in the cavity 114. The inner edge 720 engages the additional protrusion in the cavity 114 to provide additional support to the mounting portion 724. For example, the inner edge 720 may abut the additional protrusion in the cavity 114 to provide mechanical support to the mounting portion 724 when the mounting portion 724 is loaded into a cavity (not shown) of the second substrate 108 (shown in FIG. 1).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle connector configured to mate with a mating connector, the receptacle connector comprising:

a housing having a mating side configured to engage the mating connector and a mounting side configured to be mounted to a substrate, the housing including a cavity extending through the housing from the mating side to the mounting side; and a receptacle contact disposed within the cavity and configured to receive a mating contact of the mating connector, the receptacle contact comprising outwardly protruding barbs and openings disposed to permit the barbs to inwardly collapse when the receptacle contact is loaded into the cavity and the barbs engage the housing, the receptacle contact further comprising elongated shafts disposed on opposite sides of a longitudinal axis and tapered mating tips coupled to the shafts, the mating tips having tapered shapes between the shafts and outer ends of the mating tips, the mating tips and the shafts extending between opposite sides in directions oriented parallel to a lateral axis, the opposite sides of the mating tips laterally extending farther from the longitudinal axis than the opposite sides of the shafts, wherein the receptacle contact is configured to receive the mating contact of the mating connector between the mating tips.

2. The receptacle connector of claim 1, wherein the housing comprises a separation element disposed within the cavity, the mating tips of the receptacle contact engaging the separation element to maintain a separation distance between the mating tips in a direction that is transverse to the longitudinal axis and to the lateral directions.

3. The receptacle connector of claim 1, wherein the receptacle contact is a unitary conductive body.

4. The receptacle connector of claim 1, wherein the tapered shape of each of the mating tips is approximately symmetrical on opposite sides of the longitudinal axis.

5. The receptacle connector of claim 1, wherein the housing includes a separation element protruding into the cavity from an inner wall of the cavity and extending from one side to an opposite side in a direction extending between the mating tips of the receptacle contact, each of the sides engaging a different one of the mating tips prior to receiving the mating contact between the mating tips.

6. The receptacle connector of claim 1, wherein the cavity holds a single receptacle contact.

7. The receptacle connector of claim 1, wherein the receptacle contact includes a mounting portion configured to mount the receptacle contact to the substrate and a retention portion interconnecting the contact beams with the mounting portion, wherein the retention portion secures the receptacle connector in the cavity.

8. The receptacle connector of claim 7, wherein the retention portion includes retention members protruding from the retention portion and configured to engage the housing.

9. The receptacle connector of claim 7, wherein the retention portion includes the barbs.

10. A receptacle connector comprising:

a housing having a cavity extending along a longitudinal axis and shaped to receive a contact pin of a mating connector, the housing comprising a separation element protruding into the cavity; and a receptacle contact disposed within the cavity and including a protruding barb and an opening, the barb engaging the housing and securing the receptacle contact in the housing, the opening positioned to permit the barb to inwardly collapse, the receptacle contact further comprising contact beams disposed on opposite sides of and extending along the longitudinal axis, the contact beams receiving the contact pin of the mating connector, wherein the contact beams engage the separation element and the separation element maintains a separation distance between the contact beams in the cavity.

11. The receptacle connector of claim 10, wherein the contact beams include mating tips joined to elongated shafts, the mating tips being tapered from a coupling end to an outer end, the mating tips and the shafts extending between opposite sides, further wherein the opposite sides of the mating tips laterally extend in directions oriented perpendicular to the longitudinal axis farther than the opposite sides of the shafts.

12. The receptacle connector of claim 11, wherein the coupling ends of the mating tips engage the separation element in the housing to maintain the separation distance between the contact beams.

13. The receptacle connector of claim 10, wherein the contact beams comprise retention members extending in a direction transverse to the longitudinal axis to engage the housing and retain the receptacle contact in the cavity.

14. The receptacle connector of claim 10, wherein the housing comprises recesses on opposing sides of the cavity, the recesses shaped to permit the contact beams to be deflected in opposing directions transverse to the longitudinal axis.

15. The receptacle connector of claim 10, wherein the contact beams of the receptacle contact include mating tips having symmetrical tapered shapes, each of the mating tips being approximately symmetrical on opposite sides of the longitudinal axis.

16. The receptacle connector of claim 10, wherein the separation element extends from one side to an opposite side in a direction extending between the contact beams of the receptacle contact, each of the sides engaging a different one of the contact beams prior to receiving the contact pin between the contact beams.

17. The receptacle connector of claim 10, wherein the cavity holds a single receptacle contact.

18. The receptacle connector of claim 10, wherein the contact beams of the receptacle contact have symmetrically tapered mating tips joined with the contact beams, the mating tips having larger widths in directions parallel to a lateral axis than largest widths of the contact beams in directions parallel to the lateral axis.

19. The receptacle connector of claim 10, wherein the receptacle contact comprises a mounting portion interconnected with the contact beams and configured to mechanically and electrically couple the receptacle contact with a substrate.

20. The receptacle connector of claim 19, further comprising a retention portion interconnecting the contact beams with the mounting portion, wherein the retention portion engages the housing to limit movement of the receptacle contact in the cavity along the longitudinal axis.

* * * * *